US011266866B1

(12) United States Patent
Wiltshire

(10) Patent No.: US 11,266,866 B1
(45) Date of Patent: Mar. 8, 2022

(54) PORTABLE EXERCISE DEVICE

(71) Applicant: Staphanus Wiltshire, North Bethesda, MD (US)

(72) Inventor: Staphanus Wiltshire, North Bethesda, MD (US)

( * ) Notice: Subject to any disclaimer, the term of this patent is extended or adjusted under 35 U.S.C. 154(b) by 63 days.

(21) Appl. No.: 16/890,101

(22) Filed: Jun. 2, 2020

(51) Int. Cl.
*A63B 21/00* (2006.01)
*A63B 21/04* (2006.01)
*A63B 21/055* (2006.01)

(52) U.S. Cl.
CPC .... *A63B 21/00185* (2013.01); *A63B 21/0442* (2013.01); *A63B 21/0557* (2013.01); *A63B 21/4034* (2015.10); *A63B 21/4035* (2015.10); *A63B 21/4043* (2015.10); *A63B 2210/50* (2013.01); *A63B 2225/09* (2013.01)

(58) Field of Classification Search
CPC ..... A63B 21/00185; A63B 21/4043; A63B 21/4034; A63B 21/0442; A63B 21/4035; A63B 21/0557; A63B 2225/09; A63B 2210/50; A63B 1/00–005; A63B 3/00; A63B 5/04; A63B 5/20; A63B 7/00–085; A63B 15/00–02; A63B 21/0004–00043; A63B 21/02; A63B 21/04; A63B 21/055–057; A63B 21/16; A63B 2023/006
See application file for complete search history.

(56) References Cited

U.S. PATENT DOCUMENTS

| | | | | |
|---|---|---|---|---|
| 5,171,295 | A | 12/1992 | Schwalm, Jr. | |
| 5,318,494 | A * | 6/1994 | Santighian | A63B 21/0004 482/121 |
| 5,431,617 | A * | 7/1995 | Rattray, Jr. | A63B 21/04 482/121 |
| 6,319,179 | B1 * | 11/2001 | Hinds | A63B 21/0552 482/121 |
| 7,946,970 | B2 | 5/2011 | Garza, Jr | |
| D654,124 | S | 2/2012 | Davis | |
| 9,259,606 | B2 | 2/2016 | Wolan | |
| 9,345,346 | B1 * | 5/2016 | O'Flaherty | B65H 75/36 |
| 9,649,522 | B2 | 5/2017 | Wyatt | |
| 10,207,140 | B2 | 2/2019 | Carriere, Jr. | |
| 10,220,236 | B2 * | 3/2019 | Oltorik, Jr. | A63B 21/4043 |
| 10,232,212 | B1 * | 3/2019 | Cohen | A63B 21/0552 |

(Continued)

FOREIGN PATENT DOCUMENTS

WO 2015017838 2/2015

*Primary Examiner* — Joshua Lee
*Assistant Examiner* — Catrina A Letterman

(57) ABSTRACT

The portable exercise device is a physical training device. The portable exercise device is an elastic structure that generates a counterforce used to exercise muscles. The portable exercise device comprises a plurality of resistance bands, a plurality of supporting bars, and a plurality of carabiners. The plurality of carabiners attaches the plurality of resistance bands to the plurality of supporting bars. Each of the plurality of supporting bars is a rigid structure to which the plurality of resistance bands anchors. The plurality of supporting bars are manipulated to apply deformation forces to the plurality of resistance bands during the use of the portable exercise device. The plurality of resistance bands generates the counterforce used to exercise muscles as each of the plurality of resistance bands returns to the relaxed shape.

18 Claims, 4 Drawing Sheets

(56) References Cited

U.S. PATENT DOCUMENTS 10,512,813 B1 * 12/2019 Hayward ..... A63B 23/0205
11,033,774 B1 * 6/2021 Clarke ..... A63B 21/00185
2005/0059537 A1 * 3/2005 Hull ..... A63B 21/0552 482/124
2007/0254786 A1 * 11/2007 Owen ..... A63B 21/0552 482/121
2008/0096737 A1 * 4/2008 Ayoub ..... A63B 21/0724 482/107
2008/0113852 A1 * 5/2008 Caldwell ..... A63B 23/03541 482/133
2008/0214369 A1 * 9/2008 Mancini ..... A63B 21/0552 482/121
2009/0137371 A1 * 5/2009 Fuller ..... A63B 23/1281 482/122
2009/0192022 A1 * 7/2009 Kulka ..... A63B 21/153 482/46
2010/0126902 A1 * 5/2010 Garza, Jr. ..... A63B 23/12 206/579
2011/0130253 A1 * 6/2011 Fuller ..... A63B 21/169 482/122
2011/0219586 A1 * 9/2011 Musachio ..... A63B 21/0004 24/300
2012/0165167 A1 * 6/2012 Hauptmann ..... A63B 21/16 482/123
2012/0202662 A1 * 8/2012 DeMarco ..... A63B 23/1236 482/143
2014/0155232 A1 * 6/2014 Wolan ..... A63B 21/4033 482/123
2014/0274607 A1 * 9/2014 Kaye ..... A63B 21/0442 482/130
2014/0342883 A1 * 11/2014 Joost ..... A63B 21/028 482/129
2015/0238799 A1 * 8/2015 Arline ..... A63B 71/02 482/129
2015/0251039 A1 * 9/2015 Mikulski ..... A63B 21/0442 482/126
2020/0289874 A1 * 9/2020 Sanders ..... A63B 21/0414
2020/0346062 A1 * 11/2020 Li ..... A63B 21/068
2021/0170219 A1 * 6/2021 Lewis ..... A63B 21/4035

* cited by examiner

PORTABLE EXERCISE DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of apparatus for physical training including strengthening muscles by working against a counter force, more specifically, an apparatus wherein the counter force comprises an elastic force resistor anchored at one end and manipulated at the other end. (A63B21/0442)

SUMMARY OF INVENTION

The portable exercise device is a physical training device. The portable exercise device is an elastic structure that generates a counterforce used to exercise muscles. The portable exercise device comprises a plurality of resistance bands, a plurality of supporting bars, and a plurality of carabiners. The plurality of carabiners attaches the plurality of resistance bands to the plurality of supporting bars. Each of the plurality of supporting bars is a rigid structure to which the plurality of resistance bands anchors. The plurality of supporting bars are manipulated to apply deformation forces to the plurality of resistance bands during the use of the portable exercise device. The plurality of resistance bands generates the counterforce used to exercise muscles as each of the plurality of resistance bands returns to the relaxed shape.

These together with additional objects, features and advantages of the portable exercise device will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable exercise device in detail, it is to be understood that the portable exercise device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable exercise device.

It is therefore important that the claims be regarded as including such equivalent construction insofar as they do not depart from the spirit and scope of the portable exercise device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
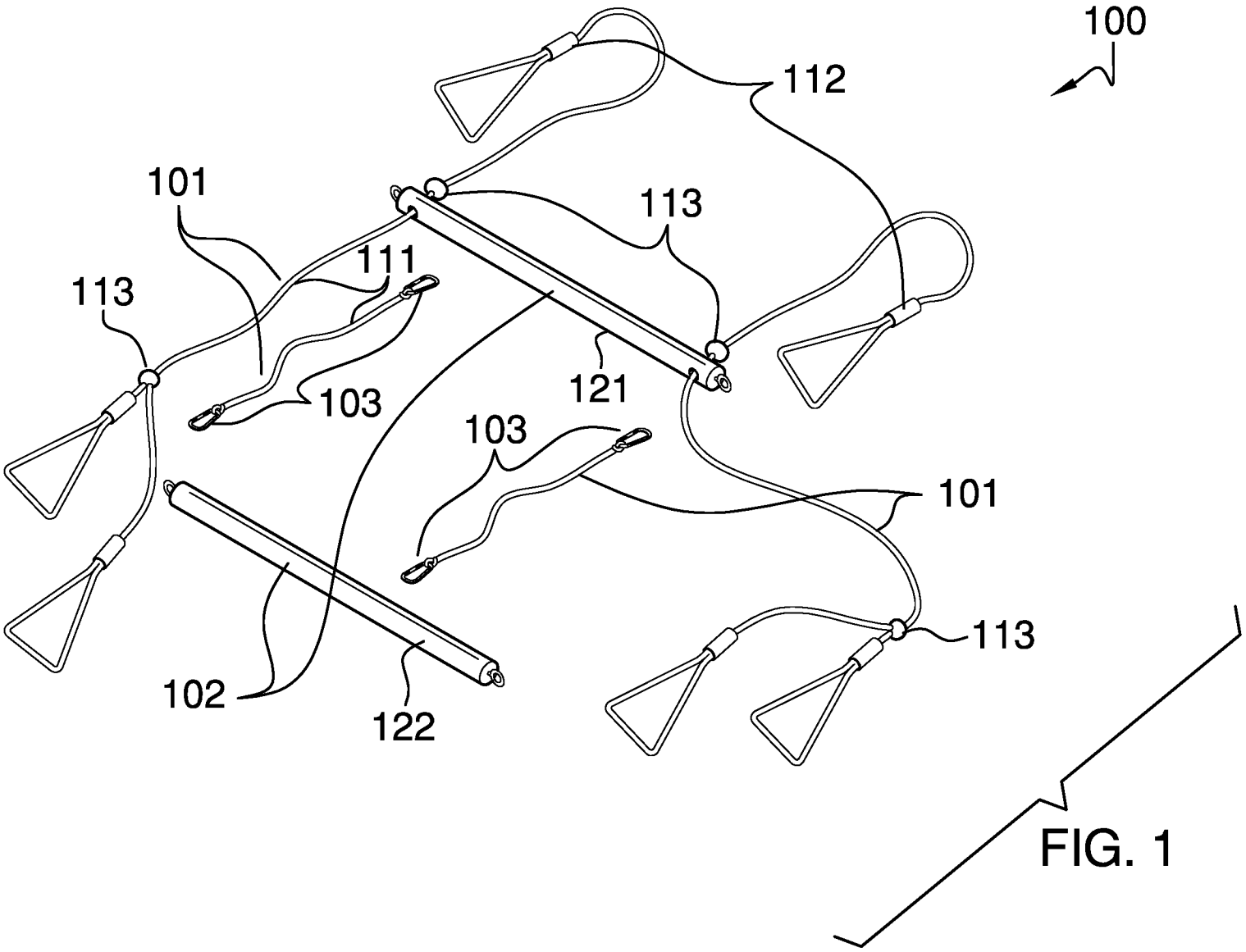
FIG. 1 is a perspective view of an embodiment of the disclosure.
Figure 2:
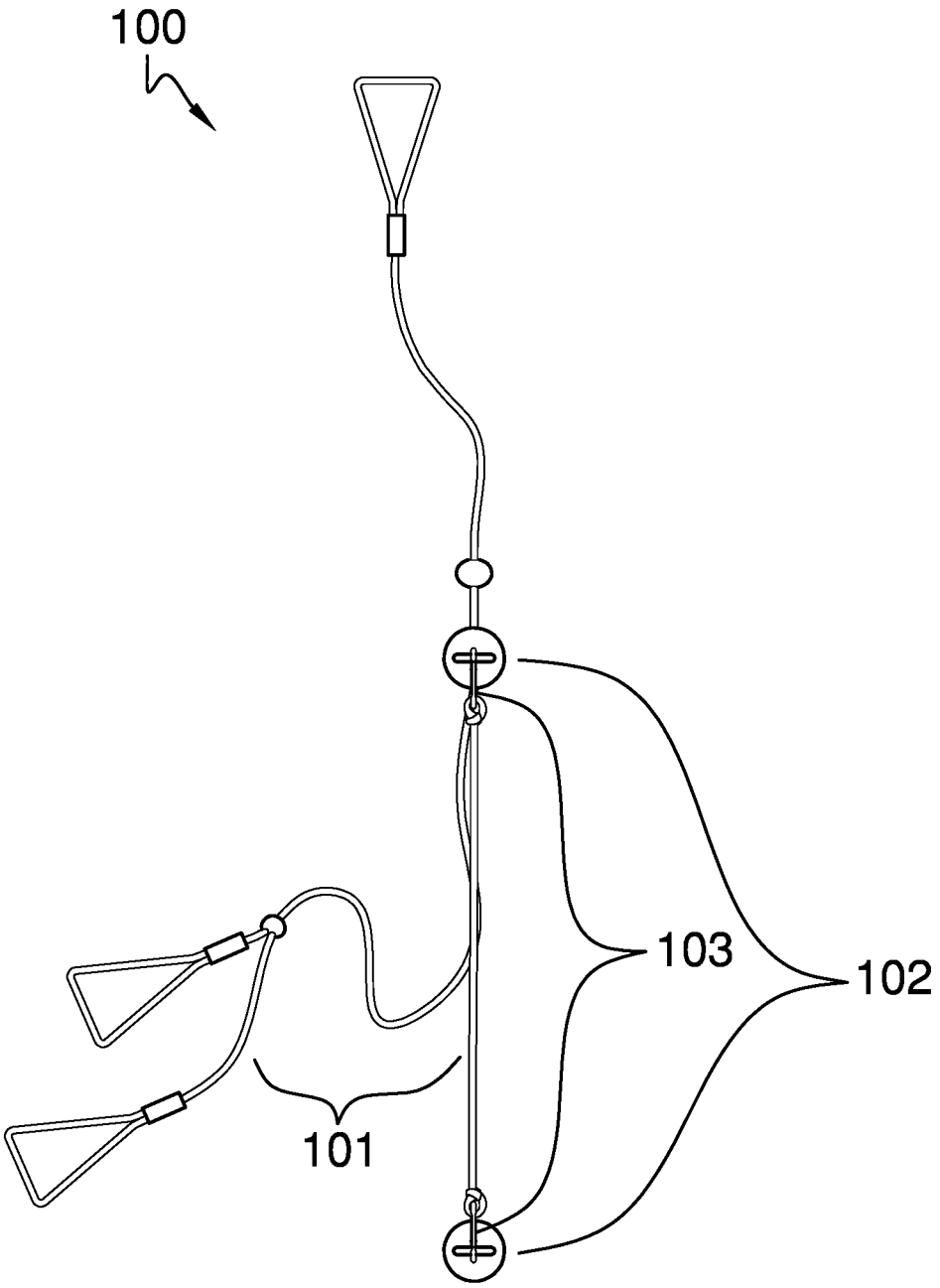
FIG. 2 is a side view of an embodiment of the disclosure.
Figure 3:
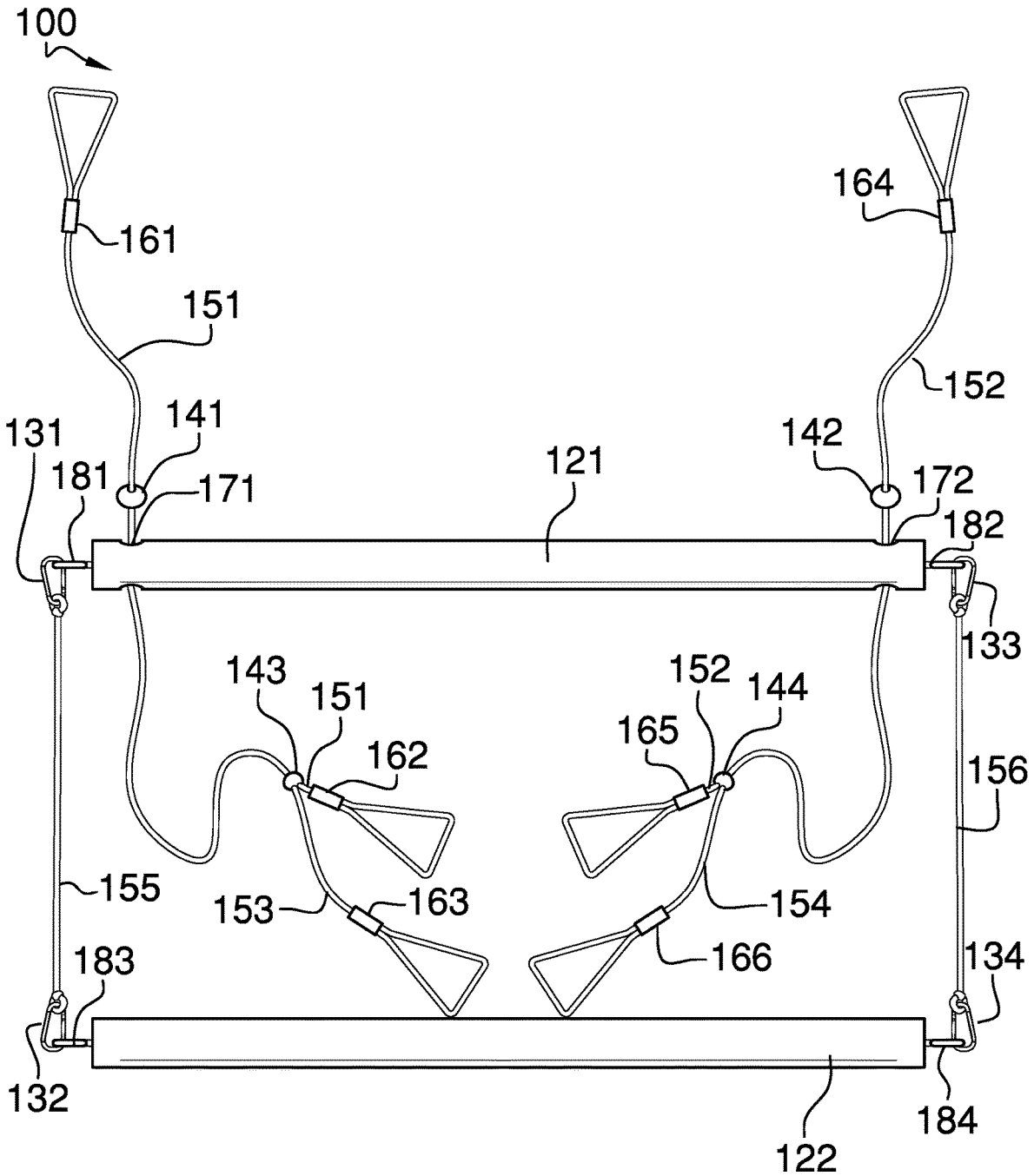
FIG. 3 is a front view of an embodiment of the disclosure.
Figure 4:
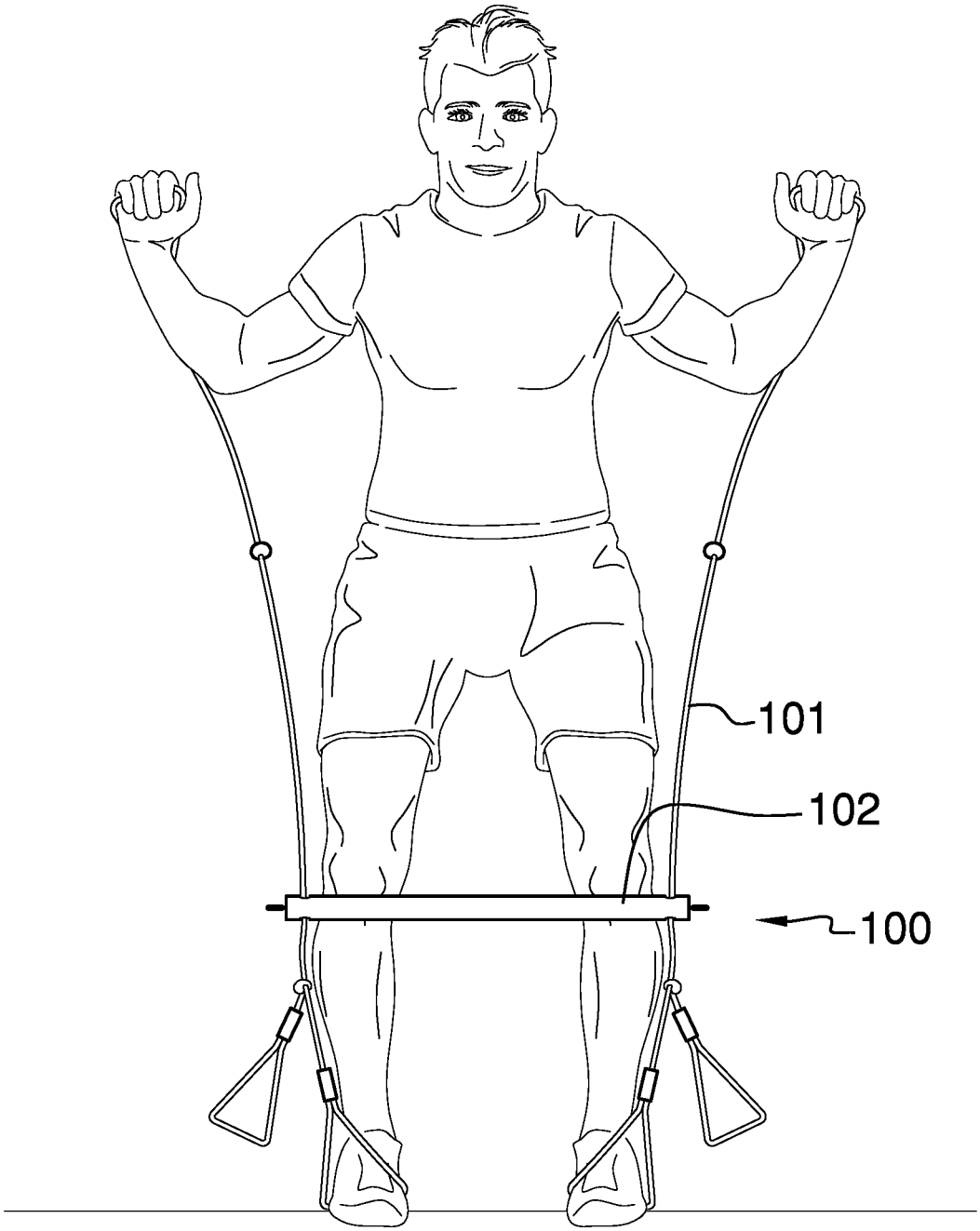
FIG. 4 is an in-use view of an embodiment of the disclosure.

Detailed reference will now be made to one or more potential embodiments of the disclosure, which are illustrated in FIGS. 1 through 4.

The portable exercise device 100 (hereinafter invention) is a physical training device. The invention 100 is an elastic structure that generates a counterforce used to exercise muscles. The invention 100 comprises a plurality of resistance bands 101, a plurality of supporting bars 102, and a plurality of carabiners 103. The plurality of carabiners 103 attaches the plurality of resistance bands 101 to the plurality of supporting bars 102. Each of the plurality of supporting bars 102 is a rigid structure to which the plurality of resistance bands 101 anchors. The plurality of supporting bars 102 are manipulated to apply deformation forces to the plurality of resistance bands 101 during the use of the invention 100. The plurality of resistance bands 101 generates the counterforce used to exercise muscles as each of the plurality of resistance bands 101 returns to the relaxed shape.

Each of the plurality of resistance bands 101 is an elastic structure. Each of the plurality of resistance bands 101 is deformed by a motive force. Each resistance band selected from the plurality of resistance bands 101 generates a counterforce that returns the selected resistance band to its relaxed shape. The plurality of resistance bands 101 comprises a plurality of bungee cords 111, a plurality of cord locks 112, and a plurality of control structures 113.

Each bungee cord selected from the plurality of bungee cords 111 is an elastic cord. The elastic cord is defined elsewhere in this disclosure. Each bungee cord selected from the plurality of bungee cords 111 generates the resistive counterforce generated by the invention 100. The plurality of bungee cords 111 comprises a first bungee cord 151, a second bungee cord 152, a third bungee cord 153, a fourth bungee cord 154, a fifth bungee cord 155, and a sixth bungee cord 156.

The first bungee cord 151 forms the resistance element of a resistance band selected from the plurality of resistance bands 101. The first bungee cord 151 threads through the first radial hole 171 of the superior supporting bar 121. The second bungee cord 152 forms the resistance element of a resistance band selected from the plurality of resistance bands 101. The second bungee cord 152 threads through the second radial hole 172 of the superior supporting bar 121.

The third bungee cord 153 forms the resistance element of a resistance band selected from the plurality of resistance bands 101. The third bungee cord 153 attaches to the lateral face of the first bungee cord 151. The fourth bungee cord 154 forms the resistance element of a resistance band selected from the plurality of resistance bands 101. The fourth bungee cord 154 attaches to the lateral face of the second bungee cord 152.

The fifth bungee cord 155 forms the resistance element of a resistance band selected from the plurality of resistance bands 101. The fifth bungee cord 155 attaches a congruent end of the prism structure of the superior supporting bar 121 to a congruent end of the prism structure of the inferior supporting bar 122. The sixth bungee cord 156 forms the resistance element of a resistance band selected from the plurality of resistance bands 101. The sixth bungee cord 156 attaches a congruent end of the prism structure of the superior supporting bar 121 to a congruent end of the prism structure of the inferior supporting bar 122.

Each of the plurality of cord locks 112 is a cord lock. The cord lock is defined elsewhere in this disclosure. Each of the plurality of cord locks 112 forms a loop in the end of a bungee cord selected from the plurality of bungee cords 111. Each of the plurality of cord locks 112 is adjustable such that the size of the loop formed in the end of the selected bungee cord is adjustable. The plurality of cord locks 112 comprises a first cord lock 161, a second cord lock 162, a third cord lock 163, a fourth cord lock 164, a fifth cord lock 165, and a sixth cord lock 166.

The first cord lock 161 is the cord lock selected from the plurality of cord locks 112 that forms a loop in an end of the first bungee cord 151. The second cord lock 162 is the cord lock selected from the plurality of cord locks 112 that forms a loop in the end of the first bungee cord 151 that is distal from the first cord lock 161. The third cord lock 163 is the cord lock selected from the plurality of cord locks 112 that forms a loop in the end of the third bungee cord 153 that is distal from the attachment point of the third bungee cord 153 to the first bungee cord 151.

The fourth cord lock 164 is the cord lock selected from the plurality of cord locks 112 that forms a loop in an end of the second bungee cord 152. The fifth cord lock 165 is the cord lock selected from the plurality of cord locks 112 that forms a loop in the end of the second bungee cord 152 that is distal from the fourth cord lock 164. The sixth cord lock 166 is the cord lock selected from the plurality of cord locks 112 that forms a loop in the end of the fourth bungee cord 154 that is distal from the attachment point of the fourth bungee cord 154 to the second bungee cord 152.

Each of the plurality of control structures 113 is a mechanical structure. Each of the plurality of control structures 113 attaches to one or more bungee cords selected from the plurality of bungee cords 111. Each of the plurality of control structures 113 performs a function selected from the group consisting of: a) limiting the range of motion of a bungee cord selected from the plurality of bungee cords 111 relative to a supporting bar selected from the plurality of cord locks 112; and, b) attaching the end of an initial bungee cord selected from the plurality of bungee cords 111 to the lateral face of a subsequent bungee cord selected from the plurality of bungee cords 111. The plurality of control structures 113 comprises a first stopper 141, a second stopper 142, a first splitter 143, and a second splitter 144.

The first stopper 141 is a mechanical structure. The first stopper 141 attaches to the lateral face along the first bungee cord 151. The position of the first stopper 141 along the first bungee cord 151 is adjustable. The first stopper 141 forms a barrier that limits the movement of the first bungee cord 151 through the first radial hole 171 of the superior supporting bar 121.

The second stopper 142 is a mechanical structure. The second stopper 142 attaches to the lateral face along the second bungee cord 152. The position of the second stopper 142 along the second bungee cord 152 is adjustable. The second stopper 142 forms a barrier that limits the movement of the second bungee cord 152 through the second radial hole 172 of the superior supporting bar 121.

The first splitter 143 is a mechanical structure. The first splitter 143 permanently attaches an end of the third bungee cord 153 to the lateral face of the first bungee cord 151.

The second splitter 144 is a mechanical structure. The second splitter 144 permanently attaches an end of the fourth bungee cord 154 to the lateral face of the second bungee cord 152.

Each of the plurality of supporting bars 102 is a rigid structure. Each of the plurality of supporting bars 102 forms an anchor point to which a resistance band selected from the plurality of resistance bands 101 attaches. Each of the plurality of supporting bars 102 sets the position of any first resistance band selected from the plurality of resistance band 101 to a second resistance band selected from the plurality of resistance band 101. The plurality of supporting bars 102 comprises a superior supporting bar 121 and an inferior supporting bar 122.

The superior supporting bar 121 is a rigid prism structure selected from the plurality of supporting bars 102. The superior supporting bar 121 fixes the position of the first bungee cord 151 relative to the second bungee cord 152. The superior supporting bar 121 fixes the position of the fifth bungee cord 155 relative to the sixth bungee cord 156. The superior supporting bar 121 comprises a first radial hole 171, a second radial hole 172, a first anchor ring 181, and a second anchor ring 182.

The first radial hole 171 is a radial hole formed through the prism structure of the superior supporting bar 121. The first radial hole 171 is sized to allow the insertion of the first bungee cord 151 through the superior supporting bar 121. The second radial hole 172 is a radial hole formed through the prism structure of the superior supporting bar 121. The second radial hole 172 is sized to allow the insertion of the second bungee cord 152 through the superior supporting bar 121. The first anchor ring 181 is a ring structure that attaches to a congruent end of the prism structure of the superior supporting bar 121. The second anchor ring 182 is a ring structure that attaches to the congruent end of the prism structure of the superior supporting bar 121 that is distal from the first anchor ring 181.

The inferior supporting bar 122 is a rigid prism structure selected from the plurality of supporting bars 102. The inferior supporting bar 122 fixes the position of the fifth bungee cord 155 relative to the sixth bungee cord 156. The inferior supporting bar 122 comprises a third anchor ring 183 and a fourth anchor ring 184.

The third anchor ring 183 is a ring structure that attaches to a congruent end of the prism structure of the inferior supporting bar 122. The fourth anchor ring 184 is a ring structure that attaches to the congruent end of the prism structure of the inferior supporting bar 122 that is distal from the third anchor ring 183.

Each of the plurality of carabiners 103 is a carabiner. The carabiner is defined elsewhere in this disclosure. Each carabiner selected from the plurality of carabiners 103 removably attaches a resistance band selected from the plurality of resistance bands 101 to a supporting bar selected from the plurality of supporting bars 102. The plurality of carabiners 103 comprises a first carabiner 131, a second carabiner 132, a third carabiner 133, and a fourth carabiner 134.

The first carabiner 131 is a fastening structure. The first carabiner 131 removably attaches the fifth bungee cord 155 to the first anchor ring 181 of the superior supporting bar 121. The second carabiner 132 is a fastening structure. The second carabiner 132 removably attaches the fifth bungee cord 155 to the third anchor ring 183 of the inferior supporting bar 122. The third carabiner 133 is a fastening structure. The third carabiner 133 removably attaches the sixth bungee cord 156 to the second anchor ring 182 of the superior supporting bar 121. The fourth carabiner 134 is a fastening structure. The fourth carabiner 134 removably attaches the sixth bungee cord 156 to the fourth anchor ring 184 of the inferior supporting bar 122.

The first carabiner 131 removably attaches the fifth bungee cord 155 to the superior supporting bar 121 by anchoring to the first anchor ring 181. The third carabiner 133 removably attaches the sixth bungee cord 156 to the superior supporting bar 121 by anchoring to the second anchor ring 182.

The second carabiner 132 removably attaches the fifth bungee cord 155 to the inferior supporting bar 122 by anchoring to the third anchor ring 183. The fourth carabiner 134 removably attaches the sixth bungee cord 156 to the inferior supporting bar 122 by anchoring to the fourth anchor ring 184.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Carabiner: As used in this disclosure, a carabiner is a coupling link that is usually formed as an oblong metal ring with one spring hinged side that is used to open and close the ring. Synonyms for carabiner include D-link.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Cord Lock: As used in this disclosure, a cord lock is a device that: a) is used to tighten cords or drawstrings without the use of knots; or, b) is used to form a loop in a cord.

Correspond: As used in this disclosure, the term correspond is used as a comparison between two or more objects wherein one or more properties shared by the two or more objects match, agree, or align within acceptable manufacturing tolerances.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter Diametrically Opposed: As used in this disclosure, diametrically opposed is a term that describes the locations of a first object and a second object located at opposite ends of a diameter drawn through a third object. The term diametric opposition can also be used to describe this relationship.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Cord: As used in this disclosure, an elastic cord is a cord that contains elastic yarns as some of the yarns that make up the cord. An elastic cord is constructed such that the elastic cord will stretch when a force is applied and will return to its original shape when after the force is removed. Shock cord and bungee cord are synonyms for elastic cord.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

N-gon: As used in this disclosure, an N-gon is a regular polygon with N sides wherein N is a positive integer number greater than 2.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Perimeter: As used in this disclosure, a perimeter is one or more curved or straight lines that bounds an enclosed area on a plane or surface. The perimeter of a circle is commonly referred to as a circumference.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Radial hole: As used in this disclosure, a radial hole comprises a hole that is formed through a solid cylinder such that: 1) the formed hole is cylindrical; 2) the center axis of the formed hole is perpendicular to the center axis of the solid cylinder; and, 3) the center axis of the formed hole intersects the center axis of the solid cylinder. When the term radial hole is applied to a pipe, or other hollow cylindrical object, the term applies to two holes that are formed in the surface of the pipe in a manner that is consistent with the solid cylinder definition. When the term radial hole is applied to a prism formed from an N-gon when N is an even number, the assumption should be made that the center axis is formed by a line that connects the center of the first corresponding face of the prism to the center of the second corresponding face of the prism.

Relaxed Shape: As used in this disclosure, a structure is considered to be in its relaxed state when no shear, strain, or torsional forces are being applied to the structure.

Ring: As used in this disclosure, a ring is term that is used to describe a disk-like structure through which an aperture is formed. Rings are often considered loops.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A portable exercise device comprising a plurality of resistance bands, a plurality of supporting bars, and a plurality of carabiners;

wherein the plurality of carabiners attaches the plurality of resistance bands to the plurality of supporting bars;

wherein the portable exercise device is a physical training device;

wherein the portable exercise device is an elastic structure that generates a counterforce used to exercise muscles;

wherein each of the plurality of supporting bars is a rigid structure to which the plurality of resistance bands anchors;

wherein the plurality of supporting bars comprises a superior supporting bar and an inferior supporting bar;

wherein the superior supporting bar is a rigid prism structure selected from the plurality of supporting bars;

wherein the inferior supporting bar is a rigid prism structure selected from the plurality of supporting bars;

wherein the plurality of resistance bands generates a counterforce used to exercise muscles as each of the plurality of resistance bands returns to the relaxed shape;

wherein the plurality of resistance bands comprises a plurality of bungee cords, a plurality of cord locks, and a plurality of control structures;

wherein the plurality of bungee cords comprises a first bungee cord, a second bungee cord, a third bungee cord, a fourth bungee cord, a fifth bungee cord, and a sixth bungee cord;

wherein the first bungee cord forms the resistance element of a resistance band selected from the plurality of resistance bands;

wherein the first bungee cord threads through a supporting bar selected from the plurality of supporting bars;

wherein the second bungee cord forms the resistance element of a resistance band selected from the plurality of resistance bands;

wherein the second bungee cord threads through a supporting bar selected from the plurality of supporting bars;

wherein the third bungee cord forms the resistance element of a resistance band selected from the plurality of resistance bands;

wherein the third bungee cord attaches to the lateral face of the first bungee cord;

wherein the fourth bungee cord forms the resistance element of a resistance band selected from the plurality of resistance bands;

wherein the fourth bungee cord attaches to the lateral face of the second bungee cord;

wherein the fifth bungee cord forms the resistance element of a resistance band selected from the plurality of resistance bands;

wherein the fifth bungee cord attaches a congruent end of the prism structure of the superior supporting bar to a congruent end of the prism structure of the inferior supporting bar;

wherein the sixth bungee cord forms the resistance element of a resistance band selected from the plurality of resistance bands;

wherein the sixth bungee cord attaches a congruent end of the prism structure of the superior supporting bar to a congruent end of the prism structure of the inferior supporting bar.

2. The portable exercise device according to claim 1 wherein each of the plurality of resistance bands is an elastic structure;

wherein each of the plurality of resistance bands is deformed by a motive force;

wherein each resistance band selected from the plurality of resistance bands generates the counterforce that returns the selected resistance band to its relaxed shape.

3. The portable exercise device according to claim 2 wherein each of the plurality of supporting bars is a rigid structure;

wherein each of the plurality of supporting bars forms an anchor point to which a resistance band selected from the plurality of resistance bands attaches;

wherein each of the plurality of supporting bars sets the position of any first resistance band selected from the plurality of resistance bands to a second resistance band selected from the plurality of resistance bands.

4. The portable exercise device according to claim 3 wherein each of the plurality of carabiners is a carabiner;

wherein each carabiner selected from the plurality of carabiners removably attaches a resistance band selected from the plurality of resistance bands to a supporting bar selected from the plurality of supporting bars.

5. The portable exercise device according to claim 4 wherein the plurality of cord locks and the plurality of control structures attach to the plurality of bungee cords.

6. The portable exercise device according to claim 5 wherein the plurality of carabiners comprises a first carabiner, a second carabiner, a third carabiner, and a fourth carabiner;

wherein the first carabiner is a fastening structure;

wherein the second carabiner is a fastening structure;

wherein the third carabiner is a fastening structure;

wherein the fourth carabiner is a fastening structure.

7. The portable exercise device according to claim 6 wherein each bungee cord selected from the plurality of bungee cords is an elastic cord;

wherein each bungee cord selected from the plurality of bungee cords generates the resistive counterforce generated by the portable exercise device.

8. The portable exercise device according to claim 7 wherein the superior supporting bar fixes the position of the first bungee cord relative to the second bungee cord;

wherein the superior supporting bar fixes the position of the fifth bungee cord relative to the sixth bungee cord;

wherein the inferior supporting bar fixes the position of the fifth bungee cord relative to the sixth bungee cord.

9. The portable exercise device according to claim 8 wherein each of the plurality of cord locks is a cord lock;

wherein each of the plurality of cord locks forms a loop in the end of a bungee cord selected from the plurality of bungee cords;

wherein each of the plurality of cord locks is adjustable such that the size of the loop formed in the end of the selected bungee cord is adjustable.

10. The portable exercise device according to claim 9 wherein each of the plurality of control structures is a mechanical structure;

wherein each of the plurality of control structures attaches to one or more bungee cords selected from the plurality of bungee cords;

wherein each of the plurality of control structures performs a function selected from the group consisting of: a) limiting the range of motion of a bungee cord selected from the plurality of bungee cords relative to a supporting bar selected from the plurality of cord locks; and, b) attaching the end of an initial bungee cord selected from the plurality of bungee cords to the lateral face of a subsequent bungee cord selected from the plurality of bungee cords.

11. The portable exercise device according to claim 10 wherein the first bungee cord threads through the superior supporting bar;

wherein the second bungee cord threads through the superior supporting bar.

12. The portable exercise device according to claim 11 wherein the plurality of cord locks comprises a first cord lock, a second cord lock, a third cord lock, a fourth cord lock, a fifth cord lock, and a sixth cord lock;

wherein the first cord lock is the cord lock selected from the plurality of cord locks that forms a loop in an end of the first bungee cord;

wherein the second cord lock is the cord lock selected from the plurality of cord locks that forms a loop in the end of the first bungee cord that is distal from the first cord lock;

wherein the third cord lock is the cord lock selected from the plurality of cord locks that forms a loop in the end of the third bungee cord that is distal from the attachment point of the third bungee cord to the first bungee cord;

wherein the fourth cord lock is the cord lock selected from the plurality of cord locks that forms a loop in an end of the second bungee cord;

wherein the fifth cord lock is the cord lock selected from the plurality of cord locks that forms a loop in the end of the second bungee cord that is distal from the fourth cord lock;

wherein the sixth cord lock is the cord lock selected from the plurality of cord locks that forms a loop in the end of the fourth bungee cord that is distal from the attachment point of the fourth bungee cord to the second bungee cord.

13. The portable exercise device according to claim 12 wherein the plurality of control structures comprises a first stopper and a second stopper;

wherein the first stopper is a mechanical structure;

wherein the first stopper attaches to the lateral face along the first bungee cord;

wherein the position of the first stopper along the first bungee cord is adjustable;

wherein the first stopper forms a barrier that limits the movement of the first bungee cord through the superior supporting bar;

wherein the second stopper is a mechanical structure;

wherein the second stopper attaches to the lateral face along the second bungee cord;

wherein the position of the second stopper along the second bungee cord is adjustable;

wherein the second stopper forms a barrier that limits the movement of the second bungee cord through the superior supporting bar.

14. The portable exercise device according to claim 13 wherein the plurality of control structures further comprises a first splitter and a second splitter;

wherein the first splitter is a mechanical structure;

wherein the first splitter permanently attaches an end of the third bungee cord to the lateral face of the first bungee cord;

wherein the second splitter is a mechanical structure;

wherein the second splitter permanently attaches an end of the fourth bungee cord to the lateral face of the second bungee cord.

15. The portable exercise device according to claim 14 wherein the superior supporting bar comprises a first radial hole, a second radial hole, a first anchor ring, and a second anchor ring;

wherein the first radial hole is a radial hole formed through the prism structure of the superior supporting bar;

wherein the first radial hole is sized to allow the insertion of the first bungee cord through the superior supporting bar;

wherein the second radial hole is a radial hole formed through the prism structure of the superior supporting bar;

wherein the second radial hole is sized to allow the insertion of the second bungee cord through the superior supporting bar;

wherein the first anchor ring is a ring structure that attaches to a congruent end of the prism structure of the superior supporting bar;

wherein the second anchor ring is a ring structure that attaches to the congruent end of the prism structure of the superior supporting bar that is distal from the first anchor ring.

16. The portable exercise device according to claim 15 wherein the first bungee cord threads through the first radial hole of the superior supporting bar;

wherein the second bungee cord threads through the second radial hole of the superior supporting bar;

wherein the first stopper forms a barrier that limits the movement of the first bungee cord through the first radial hole of the superior supporting bar;

wherein the second stopper forms a barrier that limits the movement of the second bungee cord through the second radial hole of the superior supporting bar.

17. The portable exercise device according to claim 16 wherein the inferior supporting bar comprises a third anchor ring and a fourth anchor ring;

wherein the third anchor ring is a ring structure that attaches to a congruent end of the prism structure of the inferior supporting bar;

wherein the fourth anchor ring is a ring structure that attaches to the congruent end of the prism structure of the inferior supporting bar that is distal from the third anchor ring.

18. The portable exercise device according to claim 17 wherein the first carabiner removably attaches the fifth bungee cord to the superior supporting bar by anchoring to the first anchor ring;

wherein the third carabiner removably attaches the sixth bungee cord to the superior supporting bar by anchoring to the second anchor ring;

wherein the second carabiner removably attaches the fifth bungee cord to the inferior supporting bar by anchoring to the third anchor ring;

wherein the fourth carabiner removably attaches the sixth bungee cord to the inferior supporting bar by anchoring to the fourth anchor ring.

* * * * *